US006759640B2

(12) United States Patent
Yoeda et al.

(10) Patent No.: US 6,759,640 B2
(45) Date of Patent: Jul. 6, 2004

(54) METHOD OF CONTROLLING CURRENT APPLIED TO ELECTROMAGNETICALLY DRIVEN VALVE AND CONTROL SYSTEM

(75) Inventors: Keiji Yoeda, Numazu (JP); Isao Matsumoto, Susono (JP); Kazuhiko Shiratani, Susono (JP); Shoji Katsumata, Gotemba (JP); Tametoshi Mizuta, Susono (JP); Makoto Ogiso, Mishima (JP); Hideyuki Nishida, Shuntou-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 24 days.

(21) Appl. No.: 10/278,977

(22) Filed: Oct. 24, 2002

(65) Prior Publication Data

US 2003/0080306 A1 May 1, 2003

(30) Foreign Application Priority Data

Oct. 26, 2001 (JP) ..... 2001-328900

(51) Int. Cl.[7] ..... F02D 41/22; F01L 9/04

(52) U.S. Cl. ..... 250/129.15; 123/90.11

(58) Field of Search ..... 251/129.01–129.22; 123/90.11

(56) References Cited

U.S. PATENT DOCUMENTS 5,644,280 A * 7/1997 Wilson et al. ..... 335/256
5,647,311 A * 7/1997 Liang et al. ..... 123/90.11
5,692,463 A * 12/1997 Liang et al. ..... 123/90.11
6,044,814 A 4/2000 Fuwa
6,276,318 B1 * 8/2001 Yanai et al. ..... 123/90.11

FOREIGN PATENT DOCUMENTS

JP A 11-294209 10/1999

* cited by examiner

*Primary Examiner*—Paul J. Hirsch
(74) *Attorney, Agent, or Firm*—Oliff & Berridge, PLC

(57) ABSTRACT

When a displacement of an armature of an electromagnetically driven valve fails to reach a predetermined threshold value even after an elapse of a predetermined time from switching opening/closing of the valve, it is determined that step-out has occurred or step-out is about to occur and then the valve opening/closing control is changed. The valve opening/closing control is changed, for example, by interrupting application of current to the valve for attracting the armature released from the other valve.

16 Claims, 6 Drawing Sheets

METHOD OF CONTROLLING CURRENT APPLIED TO ELECTROMAGNETICALLY DRIVEN VALVE AND CONTROL SYSTEM

INCORPORATION BY REFERENCE

The disclosure of Japanese Patent Application No. 2001-328900 filed on Oct. 26, 2001 including the specification, drawings and abstract is incorporated herein by reference in its entirety.

BACKGROUND OF THE INVENTION

1. Field of the Invention

The invention relates to a method of controlling a current applied to an electromagnetically driven valve such as an intake valve and an exhaust valve of an internal combustion engine and a control system.

2. Description of Related Art

Conventionally, operation of an internal combustion engine is controlled by opening and closing an intake valve or an exhaust valve by a cam of a camshaft synchronously driven by a crankshaft. With recent progress of computer-controlled operation in the field of internal combustion engines, operation of an internal combustion engine is increasingly controlled by opening and closing an intake valve or an exhaust valve by an electromagnetic actuator. The use of the electromagnetic actuator enables the valve to be opened and closed at various timings. As a result, various methods of controlling the operation of an internal combustion engine (especially for a vehicle) have been proposed.

Basically, in the intake valve or the exhaust valve of an internal combustion engine, a disc-like armature is attached to a valve shaft, and a pair of electromagnets for opening and closing the electromagnetically driven valve are disposed so as to be apart from the armature by a distance equivalent to a sum of an opening/closing stroke of the valve and a thickness of the armature, respectively such that those valves face with each other. The valve is opened by applying electric current to the electromagnet for opening the valve (hereinafter referred to as the valve opening electromagnet) so as to attract the armature thereto. The valve is closed by applying electric current to the electromagnet for closing the valve (hereinafter referred to as the valve closing electromagnet) so as to attract the armature thereto. In general, as the armature is formed from a paramagnetic material such as a soft iron, each of the valve opening and valve closing electromagnets generates only an attraction force to attract the armature, not a repulsion force. As the magnetic attraction force is inversely proportional to the square of the distance, and the valve opening/closing stroke is relatively long, a size of the valve opening electromagnet, thus, has to be increased to generate the attraction force sufficient to attract the armature released from the valve closing. Likewise a size of the valve closing electromagnet has to be increased to generate the attraction force sufficient to attract the armature released from the valve opening electromagnet to the valve closing electromagnet. The electromagnetically driven intake valve or exhaust valve as aforementioned is provided with a pair of springs for urging the armature at a neutral position of the valve opening/closing stroke. More specifically, one of the pair of springs, serving as the valve opening spring, forces the armature released from the valve closing electromagnet toward the direction away from the valve closing electromagnet. The other spring, serving as the valve closing spring, forces the armature released from the valve opening electromagnet toward the direction away from the valve opening electromagnet. The aforementioned structure forms a vibration system in which a valve element including the armature, the valve shaft to which the armature is attached, and the valve body is suspended between those springs. The valve can be opened and closed by adjusting the current applied to the valve opening electromagnet and the valve closing electromagnet using resonance of the vibration system. Therefore, there is no need to increase each size of those electromagnets. Assuming that the displacement of the valve body or the armature resulting from the valve opening/closing operation is expressed as a lift amount, the lift amount is correlated with the moving speed of the valve body or the armature as shown in FIG. 1. In order to establish the relation as shown in FIG. 1, the current applied to the electromagnets may be correlated with the lift amount as shown in FIG. 2. As a result, the lift amount changes with times as shown by a solid line of FIG. 3. In the case where the electromagnet has a small capacity, and the valve movement goes out of the timing at which the resonance of the vibration system can be used for assisting the valve operation, the valve may be stuck at the neutral position of the valve opening/closing stroke. The aforementioned stuck state is typically known as "step-out".

Japanese Patent Laid-Open Publication 11-294209 discloses alternate application of current to the first and the second electromagnets synchronously with a natural period of the vibration system to gradually increase the amplitude of the armature so as to recover the valve from the step-out state. Generally reverse current is applied to the electromagnet to which application of current is interrupted so as to extinguish the residual magnetic field upon switching the opening/closing operation of the electromagnetically driven valve. Then the inductance of the valve against the reverse current is detected. If the detected inductance is smaller than a predetermined value, it is determined that the electromagnet has failed to attract the armature and, thus, the valve has been brought into the step-out state.

According to the aforementioned method, it is determined whether the armature has been attracted to the electromagnet on the basis of the inductance of the electromagnet that releases the armature against the reverse current applied thereto for extinguishing the residual magnetic field. If the inductance is smaller than a predetermined value, it is determined that the armature has not been attracted to the electromagnet and, thus, it is determined that the step-out has occurred. The valve may be recovered from the step-out by taking a required procedure so as to avoid any failure in operating the internal combustion engine owing to the step-out.

However, according to the aforementioned method, the step-out of the valve is generally detected with a delay corresponding to a period taken for operating a cycle of opening or closing the valve.

According to the aforementioned method in which the step-out is regarded as the state where the valve is stuck at a neutral position between the valve opening/closing stroke. However, there may be a case in which the valve body fails to open/close in accordance with the normal timing even if the valve is held at the closing or the opening position. Such behavior of the valve that indicates possibility of the step-out may be recovered to the normal condition after performing at least one cycle of the valve opening/closing operation.

SUMMARY OF THE INVENTION

It is an object of the invention to provide a method of controlling current applied to an electromagnetically driven valve and a control system so as to detect a failure in the valve as well as to recover the detected failure at the appropriate timing.

In a control method of current applied to an electromagnetically driven valve including a first electromagnet, a second electromagnet, an armature that is attracted by one of the first and the second electromagnets after being released from attraction of the other electromagnet so as to move a valve body of the electromagnetically driven valve between a valve opening position and a valve closing position, and a spring that holds the armature at a neutral position between a position where the armature is attracted by the first electromagnet and a position where the armature is attracted by the second electromagnet, it is determined whether a displacement of the armature is equal to or smaller than a predetermined threshold value after an elapse of a predetermined time from start of switching operation of the electromagnetically driven valve between an opening state and a closing state. When it is determined that the displacement is equal to or smaller than the predetermined threshold value, application of the current to the electromagnetically driven valve is changed so as to be different from application of current performed when it is determined that the displacement is equal to or greater than the predetermined value.

In an embodiment and drawings of the invention, it is assumed that the displacement of the valve body or the armature includes both movement for opening the valve and movement for closing the valve in opposite directions. It is also assumed that the displacement direction is expressed as being positive either in the opening or closing direction, and the displacement amount also takes a positive value measured either in the opening or closing direction.

The current application may be changed by interrupting application of the current to one of the first and the second electromagnets that is to attract the armature.

Alternatively, the current application may be changed by applying the current to one of the first and the second electromagnets that has released the armature so as to be attracted by the other electromagnet.

In a control method of current applied to electromagnetically driven valve including a first electromagnet, a second electromagnet, an armature that is attracted by one of the first and the second electromagnets after being released from attraction of the other electromagnet so as to move a valve element of the electromagnetically driven valve between a valve opening position and a valve closing position, and a spring that holds the armature at a neutral position between a position where the armature is attracted by the first electromagnet and a position where the armature is attracted by the second electromagnet, it is determined whether a displacement of the armature is equal to or smaller than a predetermined threshold value after an elapse of a predetermined time from start of switching operation of the electromagnetically driven valve between an opening state and a closing state. An abnormality in one of the opening sate and the closing state of the electromagnetically driven valve is detected when it is determined that the displacement is equal to or smaller than the threshold value.

In case of performing an open control to the electromagnetically driven intake valve of an internal combustion engine, current may be applied from the intake valve to an electromagnetically driven exhaust valve in the same cylinder so as to be closed. In case of performing a closing control to the electromagnetically driven exhaust valve of an internal combustion engine, current may be applied from the exhaust valve to an electromagnetically driven intake valve in the same cylinder so as to be closed.

The step-out may be caused by the failure in the electromagnet or the electric system. However, it is mainly caused by the structure for driving the intake or the exhaust valve, in which the valve element including the armature, valve body, and the shaft member for connecting the armature to the valve body is slidably guided by a guiding device of a bearing type. There may occur a sliding failure in the sliding portion owing to the frictional resistance. Further the lubricating oil enters the gap between the armature and the surface of the valve opening or the valve closing electromagnet on which the armature is attracted. This may form an oil film along the surface through which the armature and the electromagnet contact therebetween when the armature is attracted to the electromagnet. Therefore, the operation of releasing the armature from the electromagnet is hindered by the resistance caused by the surface tension of the oil film. The frictional resistance rapidly reduces as the sliding starts from static friction with the maximum value to the dynamic friction. Accordingly, those factors such as friction or surface tension that cause the step-out of the valve may be found at the beginning of the opening/closing operation of the electromagnetically driven valve. If those factors are detected at the beginning of the opening/closing operation, the operation delay corresponding to the time taken for 1 cycle of the valve opening/closing time may be eliminated.

The step-out caused by the aforementioned factors may be detected simultaneously with its occurrence. This makes it possible to provide the recovering procedure immediately so as to minimize the failure in operating the internal combustion engine.

The resistance owing to the friction or the oil film as described above rapidly reduces once the valve element including the valve body, the armature and the shaft member connecting the armature to the valve starts moving from one of the closed or opened position to the other position. The valve element may be stuck at the beginning of application of the reverse current to the electromagnet to which the armature has been held for extinguishing the residual magnetic field. However, the valve element can be recovered from the stuck state and start moving at the end of the reverse current application. The valve opening/closing control may be changed when it is determined that the displacement of the armature fails to reach a predetermined value even after an elapse of a predetermined time from start of switching valve opening/closing operation. This makes it possible to perform normal opening/closing of the valve even if its valve element is stuck and then starts moving with a certain delay so long as the delay is within a recoverable range.

Application of current to one of the first and the second electromagnets that is to attract the armature may be interrupted, that is, the valve opening/closing control may be discontinued, when the displacement of the armature fails to reach a predetermined threshold value even after an elapse of a predetermined time from start of switching the valve opening/closing operation. Alternatively, current may be applied to the electromagnet that has released the armature from attraction. This makes it possible to prevent the valve from stepping out owing to the stuck state of the valve element and to allow the valve to be normally operated within a predetermined number of valve opening/closing cycles.

DETAILED DESCRIPTION OF THE PREFERRED EMBODIMENTS

Figure 4:
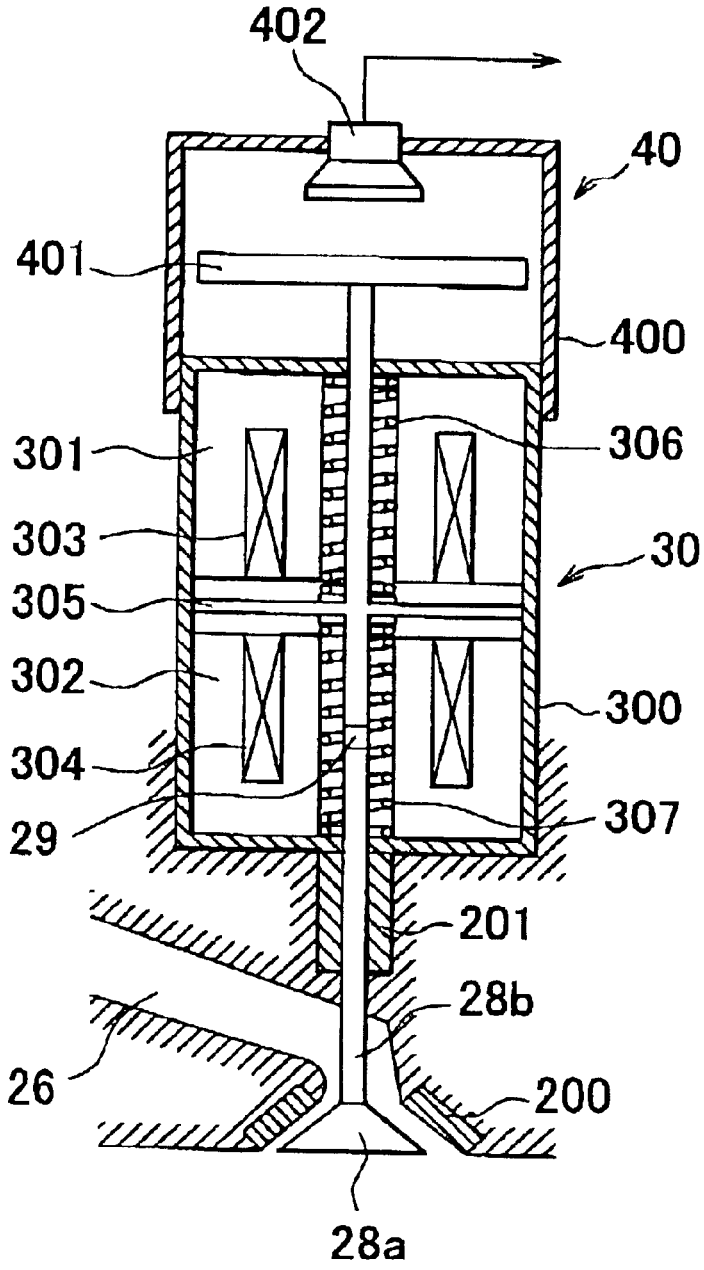
FIG. 4 is a schematic cross-sectional view showing an exemplary structure of an electromagnetically driven intake valve and an intake valve lift sensor mounted thereon.

FIG. 4 is a schematic cross-sectional view showing an example of an electromagnetically driven intake valve to which the invention is applied. Referring to FIG. 4, an intake port 26 has a valve seat 200 surrounding its opening end, and the opening end of the intake port 26 is opened and closed by a valve element 28*a* of the intake valve. The valve element 28*a* is supported by a valve shaft 28*b*. Referring to FIG. 4, a valve guide 201 serves to guide the valve shaft 28*b* so as to be moveable in the vertical direction. An electromagnetic drive unit 30 moves the valve element 28*a* between the valve opening position and the valve closing position.

The electromagnetic drive unit 30 has a housing 300, a core 301 for closing a valve (hereinafter, referred to as the valve-closing core 301), a core 302 for opening a valve (hereinafter, referred to as the valve-opening core 302), a coil 303 for closing a valve (hereinafter, referred to as the valve-closing coil 303), a coil 304 for opening a valve (hereinafter, referred to as the valve-opening coil 304), an armature 305, and compression coil springs 306, 307. When no current is applied to the coils 303, 304, the compression coil springs 306, 307 urge the armature 305 at the neutral position between the electromagnetic devices, as shown in FIG. 4.

Referring to FIG. 4, an intake valve lift sensor 40 is directly mounted on the electromagnetic drive unit 30. The lift sensor 40 has a housing 400, a disc-like target 401, and a gap sensor 402. The housing 400 is attached to the housing 300 of the electromagnetic drive unit 30. The disc-like target 401 is disposed within the housing 400, and attached to the upper end of the valve shaft 28*b*. The gap sensor 402 is attached to the housing 400 so as to face the target 401, and detects a deviation of the target 401.

A sliding joint 29 is mounted on a part of the valve shaft 28*b* in order to allow a small degree of expansion and contraction of the valve shaft 28*b* between the valve element 28*a* and the armature 305. The sliding joint 29 serves to prevent tight fit between the valve body and the valve seat under pressure within the cylinder at the compression stroke or expansion stroke from being interrupted by the armature 305 that abuts against the valve closing core 301 and the valve closing coil 303.

Figure 5:
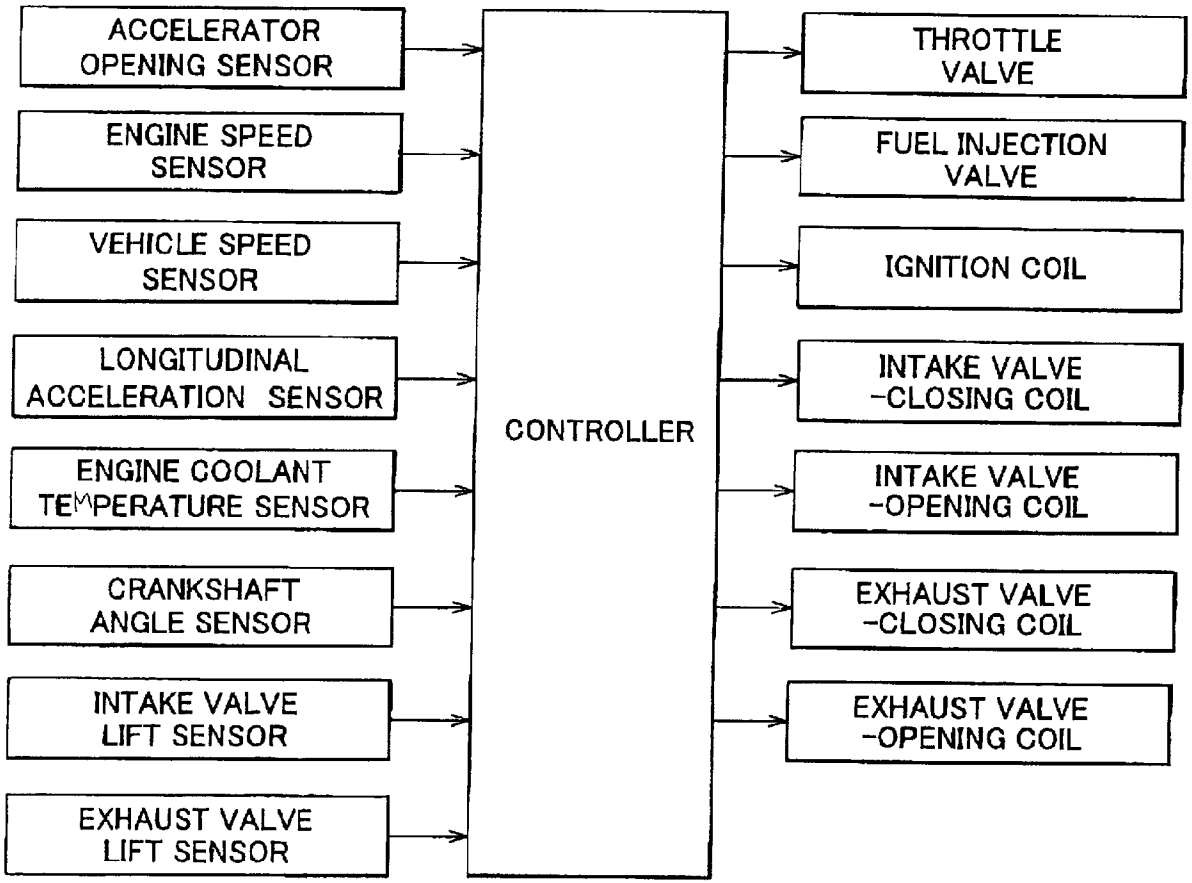
FIG. 5 schematically shows components associated with a current application control to the electromagnetically driven valve in an internal combustion engine of a vehicle.

FIG. 5 schematically shows components according to an embodiment of the invention included in the control structure for conducting in a vehicle internal combustion engine a method of controlling current applied to an electromagnetically driven valve. Operation of the internal combustion engine is controlled by a controller 100. Referring to FIG. 5, the controller 100 includes a microcomputer that receives signals from an accelerator opening sensor 1 for detecting the operation amount of an accelerator pedal by a driver, an engine speed sensor 2, a vehicle speed sensor 3, a longitudinal acceleration sensor 4, an engine coolant temperature sensor 5, a crankshaft angle sensor 6, an intake valve lift sensor 7 (in the example of FIG. 4, intake valve lift sensor 40), and an exhaust valve lift sensor 8. More specifically, the accelerator opening sensor 1 supplies a signal indicating an accelerator opening. The engine speed sensor 2 supplies a signal indicating the engine speed of the internal combustion engine. The vehicle speed sensor 3 supplies a signal indicating the vehicle speed. The longitudinal acceleration sensor 4 supplies a signal indicating acceleration in the longitudinal direction of the vehicle. The engine coolant temperature sensor 5 supplies a signal indicating the temperature of the internal combustion engine. The crankshaft angle sensor 6 supplies a signal indicating the rotating position of a crankshaft. The intake valve lift sensor 7 (corresponding to the sensor 40 shown in FIG. 4) supplies a signal indicating the opening of an intake valve. The exhaust valve lift sensor 8 supplies a signal indicating the opening of an exhaust valve. The controller 100 continuously determines how the internal combustion engine is to be operated based on the information received from the above input signals, that is, the information about the operating state of the vehicle and the internal combustion engine. According to the determination result, the controller 100 controls operation of the throttle valve 9 provided in an intake passage of the internal combustion engine; a fuel injection valve 10 for injecting fuel into the intake air of the internal combustion engine; an ignition coil 11 for operating a spark plug of the internal combustion engine; an intake valve-closing coil 12 corresponding to the valve-closing coil 303 in FIG. 4, an intake valve-opening coil 13 corresponding to the valve-opening coil 304 in FIG. 4, an exhaust valve-closing coil 14; and an exhaust-valve opening coil 15.

Figure 1:
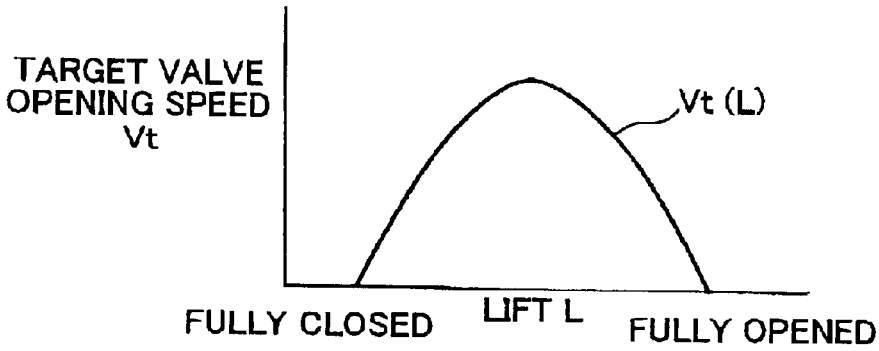
FIG. 1 is a graph showing a preferred relation between the position and the moving speed of an armature of an electromagnetically driven valve in terms of the lift and the target valve opening speed for opening the valve.

Hereinafter, a method of controlling current application to an electromagnetically driven valve according to an embodiment of the invention will be described with reference to a flowchart of FIG. 6 as an example of the control method. In this embodiment, the method is used to control the valve opening operation. However, the embodiment applies to the valve closing control as well since the term "lift L" represents the displacement of the valve that is opened and closed as described referring to FIG. 1. Moreover, steps in the flowchart are given to describe the individual functional aspects of a series of steps in the method for controlling current application to an electromagnetically driven valve according to the embodiment of the invention.

When the control routine is started by turning an ignition switch (not shown) on, signals sent from the aforementioned sensors are read in step S10. The process proceeds to step S20 where it is determined whether opening of the valve is required on the basis of the signals read in step S10. If the valve closing control is conducted, it is determined whether closing of the valve is required. If YES is obtained in step S20, the process proceeds to step S30 where it is determined whether the lift L of the armature is equal to or smaller than a predetermined small value La, that is, whether the armature has moved sufficiently apart from the valve closing electromagnet. In case of the valve closing operation, it is determined whether the armature has moved sufficiently apart from the valve opening electromagnet. If YES is obtained in step S30, the process proceeds to step S40 where the holding current that has been applied to the valve closing electromagnet during closing of the valve is interrupted. Then the process for releasing the holding current is further performed by applying reverse current to the valve closing electromagnet so as to extinguish the residual magnetic field.

Figure 6:
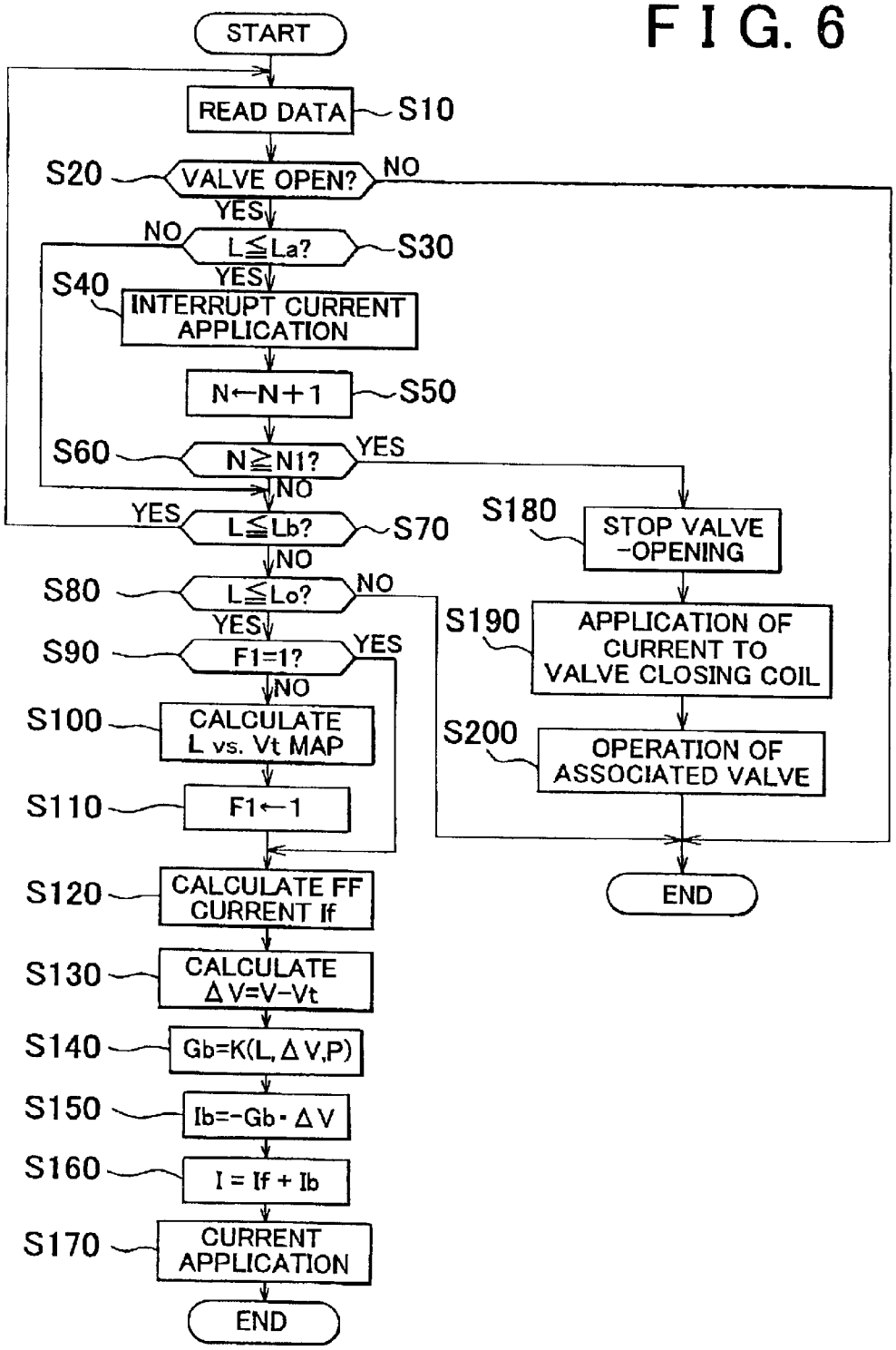
FIG. 6 is a flowchart illustrating a routine of the current application control to the electromagnetically driven valve according to the embodiment of the invention.

In step S50, the time elapsing from start of the valve opening control is calculated by the counter as a part of the controller 100 with the cycle time of the control flow in accordance with the flowchart shown in FIG. 6. The counter starts counting from 0 and increments the number N by 1. The process proceeds to step S60 where it is determined whether the count number N has reached a count number N1 corresponding to the time period taken for the count number N to reach a time point t1 from start of the valve opening operation. The time point t1 will be described in detail later. If the lift L is increased to be equal to La or greater while NO is obtained in step S60, and therefore, determination in step S30 is changed from YES to NO, the process proceeds to step S70. In step S70, it is determined whether the lift L of the armature is equal to or smaller than a predetermined value Lb (see FIG. 3). The predetermined value Lb corresponds to the value that indicates a predetermined high efficiency operation range. The process returns to step S10 until NO is obtained in step S70. When determination in step S70 changes from YES to NO, the process proceeds to step S80.

Figure 3:
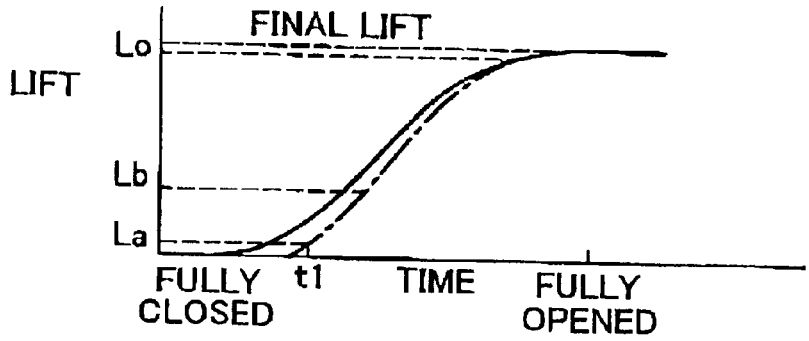
FIG. 3 is a graph showing the change in the lift L with a time axis while maintaining the relation as shown in FIG. 1.

In step S80, it is determined whether the lift L has reached a predetermined value Lo (see FIG. 3). The lift Lo indicates that the valve is substantially in a full open state. The armature may impinge on the electromagnet and bounce thereagaisnt when the lift reaches the full opening lift (see FIG. 3). The difference between the moment of the impingement and the timing represented by the control flow may interfere detection of the moment at which the valve is fully opened. Considering the aforementioned difference, the predetermined lift Lo is set to a value that is slightly smaller than that of the fully opened state. The control routine proceeds to step S90 while YES is obtained in step S80.

Figure 2:
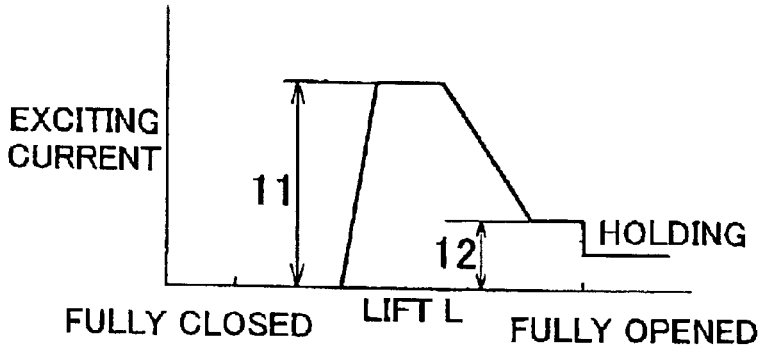
FIG. 2 is a graph showing the change in a current with respect to the lift for opening the valve while maintaining the relation as shown in FIG. 1.

In step S90, it is determined whether a flag F1 is set to "1". Basically the flag F1 is reset to 0 upon start of the control routine. The flag F1, thus, is 0 when the control routine first proceeds to step S90. Accordingly the determination in step S90 becomes NO, and the process proceeds to step S100. In step S100, a map indicating a relation between the lift L and a target valve opening speed Vt as shown in FIG. 2 is calculated. The aforementioned map is calculated on the basis of the operating state of the internal combustion engine at a moment when the electromagnetically driven valve is opened. The calculation is executed on the basis of signals of the respective sensors as shown in FIG. 5. The calculated map is set only once at the start of each valve opening (closing) operation by executing step S90 for determination of the value of the flag F1 and step S110 for setting the flag F1 to 1. Alternatively the map may be calculated through other procedures rather than calculation only once at a moment when the lift L reaches the value Lb at the valve opening or closing operation in the embodiment.

In step S120, the current If applied by feed-forward control out of the total amount of current applied to the valve opening coil is calculated on the basis of the map calculated in step S100 and the map indicating the relation between the lift L and the applied current as shown in FIG. 2. The process then proceeds to step S130.

In step 130, the valve-opening speed V at each moment of the control flow is compared with the target valve-opening speed Vt corresponding to each moment. The difference between the valve opening speed V and the target valve opening speed is calculated ($Vt(\Delta V=V-Vt)$).

Figure 7:
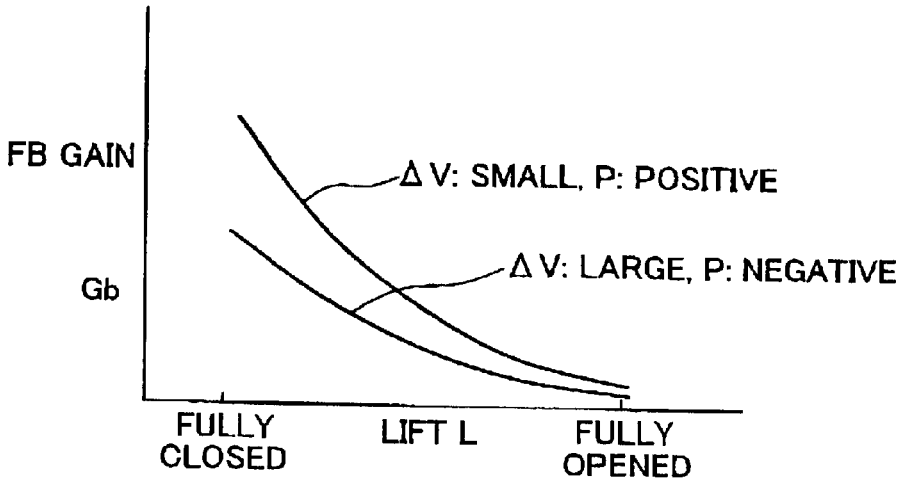
FIG. 7 is a graph showing a feedback gain calculated in accordance with a function of the lift, the difference of the moving speed of the armature between the target value and the actual value, and the direction of the force of a work fluid that acts on the valve body.

The process proceeds to step S140 where a feedback gain Gb is calculated according to the function K (L, ΔV, P). If the flow direction of the work fluid that acts on the valve element is the same as the moving direction of the valve element, the parameter P becomes positive. If those directions are different, the parameter P becomes negative. The function K used for calculating the feedback gain Gb may be used as the relation as shown in FIG. 7. Referring to FIG. 7, as the distance (=Lo−L) between the armature and the electromagnet that is to attract the armature is increased, the feedback gain is increased. If the ΔV is relatively small, the feedback gain may be increased to a value that is larger than the value obtained when the ΔV is relatively large. If the P is positive, the feedback gain may be increased to a value that is larger than the value obtained when the P is negative.

In step S150, a current value Ib, applied by the feedback control out of the total current to be applied to the valve, is calculated based on the difference ΔV and the feedback gain Gb. The feedback gain Gb is set to a positive value when the difference ΔV has a positive value. The current value Ib is calculated using the equation $Ib=-Gb\cdot\Delta V$. Then in step S160, the value I of the current applied to the valve opening coil is calculated using the equation $I=If+Ib$. The current value Ib applied by the feedback control when the actual moving speed of the armature is greater than the target moving speed is obtained by subtracting the absolute value of $Gb\cdot\Delta V$ from the current value If applied by the feedforward control. Therefore, when the ΔV has a negative value, that is, the actual moving speed is lower than the target moving speed, the feedback control using the feedback gain Gb is performed by adding the current value proportional to the absolute value of ΔV to the current value applied by the feedforward control.

In step 160, the sum of the current If applied by the feed-forward control and the current Ib applied by the feedback control is obtained as the current I. In step 170, current is applied to the valve-opening coil according to the lift L and the current application pattern as shown in FIG. 2. According to the pattern shown in FIG. 2, the current applied to the valve opening coil is rapidly increased to a large value I1 at a time point when the valve has been opened by one-third. Then the value I1 of the current is held for a predetermined period. As the valve opening operation is brought into the full opening state, the value is gradually decreased to the small value I2. The current value is further decreased to the holding current when the valve is fully opened.

The aforementioned steps S10 to S170 are repeatedly conducted every several tens of microseconds to every several hundreds of microseconds. If the valve-opening operation proceeds normally, the determination in step S80 changes from YES to NO. At this moment, the valve-opening operation is completed.

In the case where YES is obtained in step S60 before determination in step 80 changes from YES to NO, that is, the lift L is kept equal to or smaller than La even if the time elapses until the count number N reaches N1 in spite of the releasing process, the process proceeds to step S180. The time point t1 as shown by a chain line of FIG. 3 indicates the limit of delay in the valve opening/closing operation. If the delay in the valve opening/closing operation is below the time point t1, the operation of the valve can be recovered to a normal state in the subsequent cycles of the operation. When the process proceeds to step S180, the valve opening operation is stopped, and the process proceeds to step S190 where current is applied to the valve closing coil in step S190.

In the embodiment, the valve is opened from the closing state. Such valve opening operation is performed by applying current to the valve-closing coil in step S190. In the case where the valve opening operation fails, the valve is brought into closed state so as to end the control routine. In this embodiment, however, the process further proceeds to step S200 where related procedure is executed by closing the valve in the cylinder which has the valve to be opened. More specifically, when the intake valve is to be opened, the exhaust valve may be closed. Meanwhile when the exhaust valve is to be opened, the intake valve may be closed.

The flowchart shown in FIG. 6 represents the control routine for opening the valve in the closed state. However, the control routine for closing the valve in the opened state may be executed by modification of the control procedure. For example, valve opening determination is changed to the valve closing determination in step S20, the lift L is changed so as to indicate the displacement from the full opening position toward the full closing position, the valve closing operation is interrupted in step S180, current is applied to the valve opening coil in step S190, and the like.

Although the invention has been described in detail with respect to one embodiment, it should be understood by those skilled in the art that various modification can be made to the embodiment without departing from the scope of the invention.

What is claimed is:

1. A control method of current applied to an electromagnetically driven valve, the valve including a first electromagnet, a second electromagnet, an armature that is attracted by one of the first and the second electromagnets after being released from attraction of the other electromagnet so as to move a valve body of the electromagnetically driven valve between a valve opening position and a valve closing position, and a spring that holds the armature at a neutral position between a position where the armature is attracted by the first electromagnet and a position where the armature is attracted by the second electromagnet, the control method comprising the steps of:

determining whether a displacement of the armature is equal to or smaller than a predetermined threshold value after an elapse of a predetermined time from start of switching operation of the electromagnetically driven valve between an opening state and a closing state; and when it is determined that the displacement is equal to or smaller than the predetermined threshold value, changing application of current to the electromagnetically driven valve so as to be different from application of current performed when it is determined that the displacement is equal to or larger than the predetermined value.

2. A control method according to claim 1, wherein the application of current is changed by interrupting application of current to one of the first and the second electromagnets that is to attract the armature.

3. A control method according to claim 1, wherein the application of current is changed by applying current to one of the first and the second electromagnets that has released the armature so as to be attracted by the other electromagnet.

4. A control method according to claim 2, wherein the application of current is changed by applying the current to one of the first and the second electromagnets that has released the armature so as to be attracted by the other electromagnet.

5. A control method according to claim 1, wherein the electromagnetically driven valve comprises one of an intake valve and an exhaust valve of an internal combustion engine.

6. The control method according to claim 1, wherein after the operation of the electromagnetically driven valve is switched into one of the opening state and the closing state, an operation of another electromagnetically driven valve associated with the electromagnetically driven valve is changed into the other state.

7. A control method of current applied to electromagnetically driven valve, the valve including a first electromagnet, a second electromagnet, an armature that is attracted by one of the first and the second electromagnets after being released from attraction of the other electromagnet so as to move a valve element of the electromagnetically driven valve between a valve opening position and a valve closing position, and a spring that holds the armature at a neutral position between a position where the armature is attracted by the first electromagnet and a position where the armature is attracted by the second electromagnet, the control method comprising the steps of:

determining whether a displacement of the armature is equal to or smaller than a predetermined threshold value after an elapse of a predetermined time from start of switching operation of the electromagnetically driven valve between an opening state and a closing state; and detecting an abnormality in one of the opening state and the closing state of the electromagnetically driven valve when it is determined that the displacement is equal to or smaller than the threshold value.

8. A control method according to claim 7, wherein the electromagnetically driven valve comprises one of an intake valve and an exhaust valve of an internal combustion engine.

9. A control system of current applied to an electromagnetically driven valve, the valve including a first electromagnet, a second electromagnet, an armature that is attracted by one of the first and the second electromagnets after being released from attraction of the other electromagnet so as to move a valve body of the electromagnetically driven valve between a valve opening position and a valve closing position, and a spring that holds the armature at a neutral position between a position where the armature is attracted by the first electromagnet and a position where the armature is attracted by the second electromagnet, the control system comprising a controller that:

determines whether a displacement of the armature is equal to or smaller than a predetermined threshold value after an elapse of a predetermined time from start of switching operation of the electromagnetically driven valve between an opening state and a closing state; and when it is determined that the displacement is equal to or smaller than the threshold value, changes application of current to the electromagnetically driven valve so as to be different from application of current performed when it is determined that the displacement is equal to or greater than the predetermined value.

10. A control system according to claim 9, wherein the application of current is changed by interrupting application of the current to one of the first and the second electromagnets that is to attract the armature.

11. A control system according to claim 9, wherein the application of the current is changed by applying current to one of the first and the second electromagnets that has released the armature so as to be attracted by the other electromagnet.

12. A control system according to claim 10, wherein the application of current is changed by applying current to one of the first and the second electromagnets that has released the armature so as to be attracted by the other electromagnet.

13. A control system according to claim 9, wherein the electromagnetically driven valve comprises one of an intake valve and an exhaust valve of an internal combustion engine.

14. The control system according to claim 9, wherein after the operation of the electromagnetically driven valve is changed into one of the opening state and the closing state, an operation of another electromagnetically driven valve associated with the electromagnetically driven valve is changed into the other state.

15. A control system of current applied to electromagnetically driven valve, the valve including a first electromagnet, a second electromagnet, an armature that is attracted by one of the first and the second electromagnets after being released from attraction of the other electromagnet so as to move a valve element of the electromagnetically driven valve between a valve opening position and a valve closing position, and a spring that holds the armature at a neutral position between a position where the armature is attracted by the first electromagnet and a position where the armature is attracted by the second electromagnet, the control system comprising a controller that:

determines whether a displacement of the armature is equal to or smaller than a predetermined threshold value after an elapse of a predetermined time from start of changing operation of the electromagnetically driven valve between an opening state and a closing state; and detects an abnormality in one of the opening state and the closing state of the electromagnetically driven valve when it is determined that the displacement is equal to or smaller than the threshold value.

16. A control system according to claim 15, wherein the electromagnetically driven valve comprises one of an intake valve and an exhaust valve of an internal combustion engine.

* * * * *